US005113602A

United States Patent [19]

Levine et al.

[11] Patent Number: 5,113,602

[45] Date of Patent: May 19, 1992

[54] SNAP-ON KEY COVER

[75] Inventors: Mark Levine, Plainview, N.Y.; George Bellwoar, Laurel Springs, N.J.; Douglas A. Murphy, Prattville, Ala.

[73] Assignee: General Automotive Specialty Co., Inc., North Brunswick, N.J.

[21] Appl. No.: 614,631

[22] Filed: Nov. 16, 1990

[51] Int. Cl.[5] ..... G09F 3/06

[52] U.S. Cl. ..... 40/634; 40/330

[58] Field of Search ..... 40/634, 330, 159.2, 40/152; 70/456 R, 460, 461

[56] References Cited

U.S. PATENT DOCUMENTS

| | | | |
|---|---|---|---|
| 1,837,114 | 12/1931 | Cicourel | 40/330 X |
| 2,759,279 | 8/1956 | Schlage | 40/330 |
| 2,883,851 | 4/1959 | Gold | 70/456 R |
| 3,209,479 | 10/1965 | Manzardo | 40/330 |
| 4,309,883 | 1/1982 | Brentini | 70/456 X |

OTHER PUBLICATIONS

Photocopies of a folding key-head cover by Papaiz acquired in or about Sep. 1990 (Exhibits A, B, C).

Photocopies of a slip-on key-head cover (Exhibits D, E, F, G).

*Primary Examiner*—Kenneth J. Dorner

*Assistant Examiner*—J. Bonifanti

*Attorney, Agent, or Firm*—Darby & Darby

[57] ABSTRACT

A key cover comprises a hinged frame and two removably insertable insignia plates for bearing an identifying mark or logo. The frame has a recess for accommodating the head of the key and a locking means which retains the cover on the key head when the frame is folded over onto itself. The insignia plates include bosses which extend through the key ring hole of the key, for preventing the key from pivoting within the cover. The plates are inserted into openings in the frame, the key blade is inserted between the hinges and the frame is folded over onto itself. Pressure on the frame engages the locking means, which retains the cover on the key head.

7 Claims, 2 Drawing Sheets

SNAP-ON KEY COVER

BACKGROUND OF THE INVENTION

The present invention relates to a key cover and, more particularly, to a key cover which snaps into place over the key, holds the key securely and has insertable insignia plates.

Recently it has become popular to provide identifying covers for keys. These covers may serve a variety of purposes, such as distinguishing each key of a set of keys, i.e. "car key", "house key", "office key" and the like, or for promotional reasons. For example, an automobile dealer may wish to provide customers with keys bearing the company's name or logo.

However problems exist in the known key covers. Prior art key covers slip over the head of the key and allow the key to "wiggle" or have "play" rather than to remain tightly in place within the cover. Another problem associated with the known key covers is that the entire cover is a single integral piece so that otherwise identical covers bearing different insignias or logos must be made from different molds. For example, a set of identifying key covers would require a separate complete mold for each cover, e.g. the "car", "house" and "office" covers. Also, a manufacturer offering such covers would have to create a mold for the entire cover for each design ordered. The expense of creating a mold for the common parts of the covers is duplicated, making the item more expensive to manufacture than if a smaller plate mold is needed for each new insignia to be used.

SUMMARY OF THE INVENTION

The present invention is directed to a snap-on key cover comprising three pieces: a hinged frame and two plates which may bear identifying marks or insignias. The plates are removably inserted into opposite sides of the frame and the frame folds over onto itself, snapping together in position over the top (or head) of a key. Further, the two plates may have complementary bosses or projections which, when the frame is folded over, fit snugly in the keyring hole of the key, thereby firmly holding the key in place within the cover. This eliminates the "play" problem discussed above.

The plates are separately manufactured and are of uniform size so as to fit into the frame. Because all of the frames are identical, new molds are needed only for plates having different insignia. This allows the covers to be made more economically because different molds do not have to be made for the frame portion, which is larger and more intricate than the plates.

In an illustrative embodiment of the invention, a frame having two halves connected by a hinge arrangement is formed so that the key blade may be inserted in the hinge portion. Each side of the frame has a pocket into which the head of the key fits. The frame folds over onto itself to snap together, covering the head of the key, leaving the blade exposed so that the key can be used.

Each half of the frame has an opening with a lip so that an insignia plate can be inserted into each frame half and retained by the frame. The frame also includes a key-ring-receiving opening on each half, the openings being in register when the frame is closed. Each frame half also has a key-head-receiving recess. On one side of the frame,, the key ring opening is surrounded by a projecting lip which extends toward the center of the frame. On the opposite side of the frame, the key ring opening has a complementary recess which accommodates the opposite projecting lip. When the frame is folded over, the projecting lip and recess snap together firmly to hold the cover closed.

The outer surfaces of the insignia plates may be embossed, engraved, printed or otherwise marked with a symbol or word. Each plate fits snugly into position in the frame opening and is held against the lip of the frame opening by a plate base. The inner surface of the plate has a boss which is located and sized to fit in the key ring hole of the key. The boss is designed to have a height about a few thousandths of a inch less than the thickness of the key. The plate on the opposite side of the frame also has a similar boss. The bosses are arranged perpendicularly to the key blade so that when the plates are inserted into the frame and the frame is folded over, the bosses form a preferably circular rod-like element which extends between the plates and through the key ring hole and which cooperates with the pockets in the frame to prevent the key from rotating with respect to the cover.

BRIEF DESCRIPTION OF THE DRAWINGS

The foregoing and other features of the present invention will be more readily apparent from the following detailed description and drawings of an illustrative embodiment of the invention in which.

DETAILED DESCRIPTION OF PREFERRED EMBODIMENTS

Figure 1:
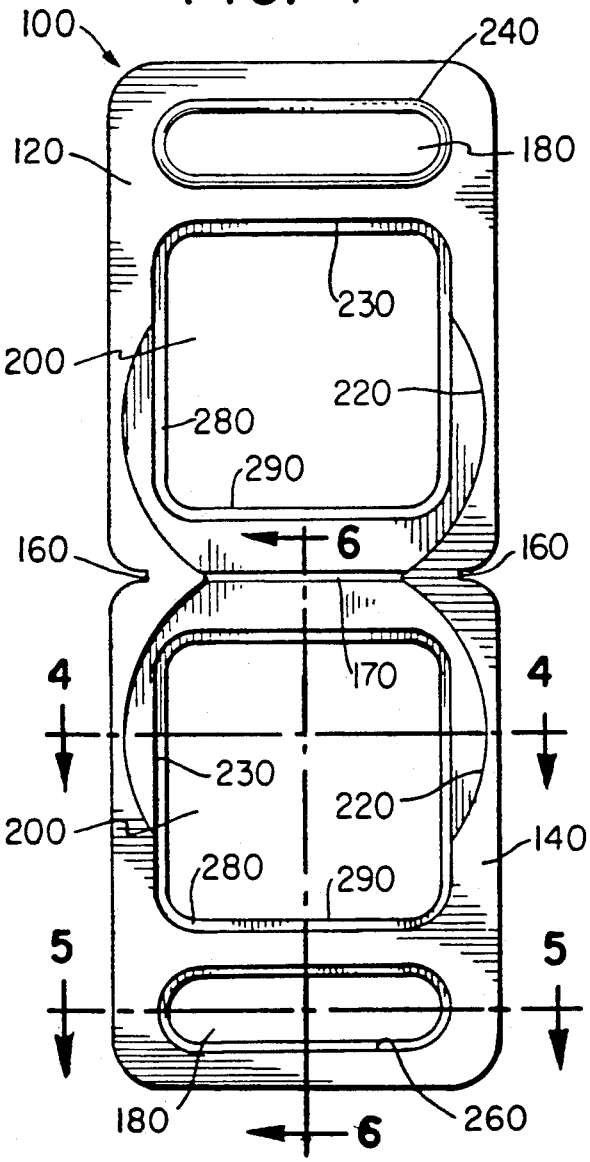
FIG. 1 is a plan view of a key cover according to the present invention, with the frame open and the plates removed.

FIG. 1 shows a frame 100 according to the present invention before it has been folded over onto itself and without the insignia plates inserted. The frame 100 comprises two halves 120,140 which are attached by a hinge arrangement formed by two hinges 160 with an opening 170 therebetween. The hinges 160 are separated by a distance great enough so that the key blade 420 (see FIG. 2) may fit into opening 170 between the hinges 160 but the key head 440 (see FIG. 11) cannot. Preferably, the frame 100 is made of a rugged material such as polypropylene to permit it to be repeatedly bent or folded at the hinges 160 without breaking. However, because the frame 100 usually need only be folded once, any pliable plastics material may be used.

Figure 2:
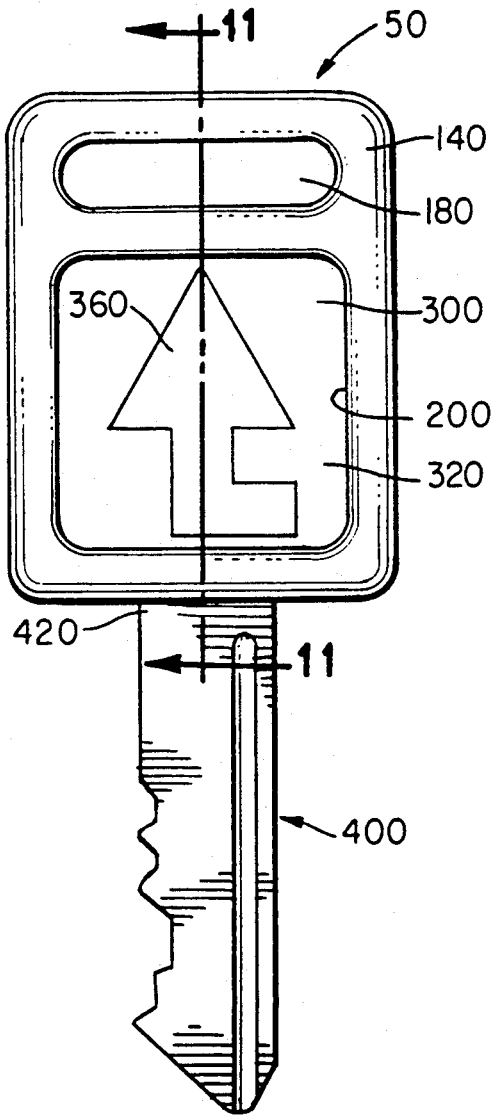
FIG. 2 is a plan view of the key cover according to the present invention, with the plates inserted, and in place on a key.

In all respects but one the two halves 120,140 are mirror images of each other. Each half 120,140 has a key-ring-receiving opening 180, the openings 180 being in alignment when the cover is folded over, as shown in FIG. 2. Each half 120,140 has an insignia-receiving opening 200, which openings preferably, but not necessarily, line up. Each half 120,140 has a key-receiving recess 220 which is hollowed out to receive the key head 440. It will be understood that the key-head-receiving recess may be entirely in one half of the frame, or unequally in the two frame halves, as may be expedient. Recess 220 is shown in cross-section in FIG. 4. The recess 220 shown in FIG. 1 is round, but it should be understood that it may be of any shape necessary to accommodate the key head.

Figure 3:
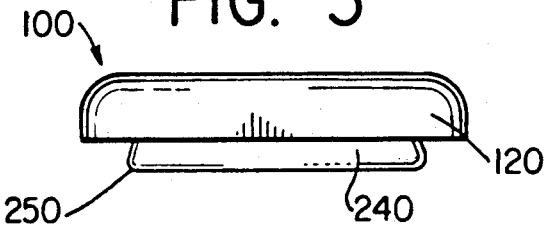
FIG. 3 is an end view of the cover of FIG. 1.
Figure 5:
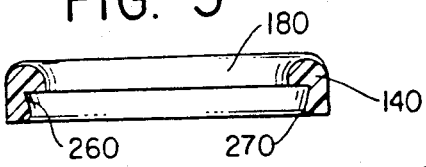
FIG. 5 is a cross-sectional view of the cover along line 5—5 of FIG. 1.
Figure 7:
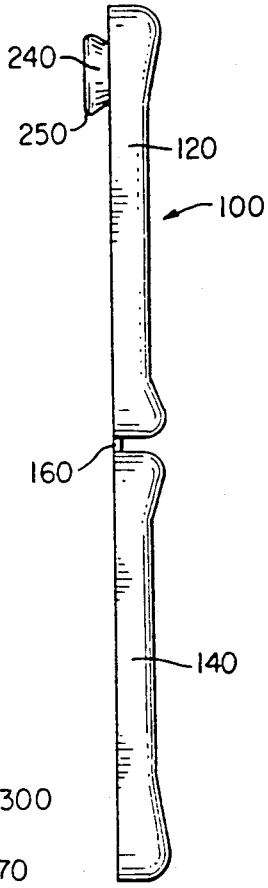
FIG. 7 is a side view of the cover of FIG. 1 in open condition.
Figure 8:
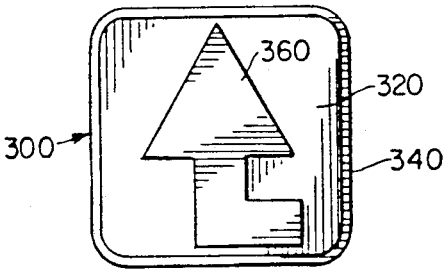
FIG. 8 is a plan view of an insignia plate according to the present invention.

The frame halves 120,140 differ in that one half 120 has a projecting locking rim 240 surrounding the key-ring-receiving opening 180 and the opposite side has a locking recess 260 around the key-ring-receiving opening 180. The projecting locking rim 240 is more clearly viewed in FIGS. 3, 7 and 11, while the locking recess 260 is shown in cross section in FIGS. 5 and 11. The projecting rim 240 angles outwardly so that the end farthest away from the frame 100 is wider than the portion adjacent to the frame as seen in FIGS. 3 and 7. The recess 260 has a complementary shape, i.e. the recess 260 is wider at its bottom than it is at the surface of the frame 100. The material chosen to make up the frame 100 is sufficiently resilient so that the recess edge 270 will yield to the projecting edge 250 when sufficient pressure is exerted downward on the projecting rim 240 towards the recess 260. Many plastics known in the art are suitable for this purpose. Once the projecting rim 240 is in place, the recess edge 270 will return to its original position. Because the recess edge 270 is narrower than the projecting edge 250, the projecting lip 240 is secured within the recess 260 to lock the frame 100 in a closed position. The frame 100 also has a lip 280 surrounding each insignia receiving opening 200, as will be further described below.

An insignia plate 300 is shown in FIGS. 8, 9*a*, 9*b* and 10. The plate 300 has a plate face 320 which, when placed within the frame, faces outward. The plate face 320 may be embossed, printed or otherwise marked with a word, symbol or the like for identification. The plate face 320 of FIGS. 8 and 11 has an illustrative symbol 360 embossed on the plate 300 but it should be understood that the symbol (if any) may be molded, printed, etched or otherwise affixed in any suitable way. The plate face 320 is integral with the plate base 340, which base 340 extends beyond the edges of the face 320.

Figure 9A:
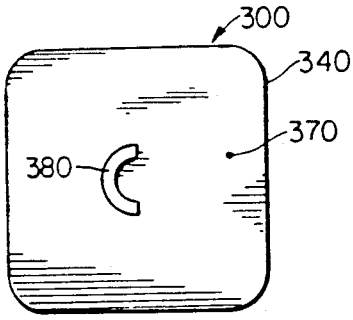
FIGS. 9*a* and 9*b* are back plan views of alternative forms of the insignia plate of FIG. 8.
Figure 9B:
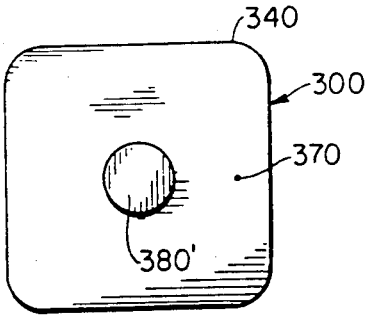
Figure 10:
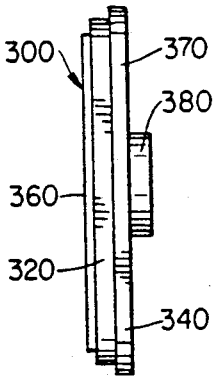
FIG. 10 is a side view of the insignia plate of FIG. 8.

The plate back 370 is shown in FIGS. 9*a* and 9*b*. The back 370 has a boss 380 which extends out from the plate back 370. The height of the boss 380 is a few thousandths of an inch less than the thickness of the key 400. The boss 380 is arranged perpendicularly with respect to the key blade. The opposing plate, i.e. the plate attached to the opposite half of the frame 100, also has a boss 380 which is positioned so that when the frame 100 is folded over onto itself, the bosses 380 form a circular rod-like element extending between the plates, without interfering with each other, and hence do not prevent the cover 50 from properly closing. Although the bosses 380 are shown as semi-circles, it is understood that they may be full half circles or any suitable variation thereof. Alternatively, each boss may be a circular element 380' having a thickness a few thousandths of an inch less than one half of the thickness of the key 400 as shown in FIG. 9*b*. The two bosses of the opposed plates being in alignment and positioned to be within the key ring hole 460 when the frame is closed about a key.

Figure 4:
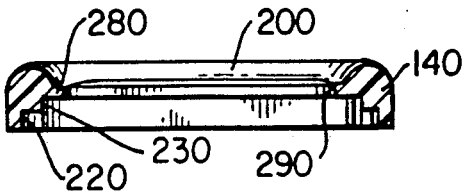
FIG. 4 is a cross-sectional view of the cover along line 4—4 of FIG. 1.
Figure 6:
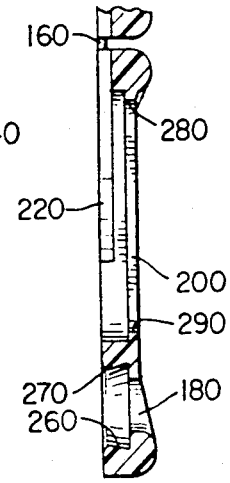
FIG. 6 is a cross-sectional view of the cover along line 6—6 of FIG. 1.

The insignia-receiving opening 200 is shown in cross section in FIGS. 4 and 6. The frame 100 has a lip 280 surrounding each insignia-receiving opening 200, as described above. The insignia-receiving opening 200 and the plate face 320 are identically shaped with the opening 200 being slightly larger than the plate face 320. The plate base 340 and the frame wall 230 are also identically shaped, with the frame wall 230 being slightly wider. The insignia plates 300 are tightly held in place because the plate face 320 is held tightly against the lip edge 290 and the plate base 340 may be held against the frame wall 230. The protruding lip 280 prevents the plate 300 from passing through the opening 200 because the opening is smaller than the plate base 340.

Once the plates 300 are placed into the frame 100, the key 400 may be inserted into the cover 50, in the opening 170 between the hinges 160, so that the key head 440 rests within the key-receiving-recess 220. The frame 100 is then folded over onto itself and pressed so that the locking projecting rim 240 snaps into the locking recess 260 to retain the frame closed around the key head 440.

Figure 12:
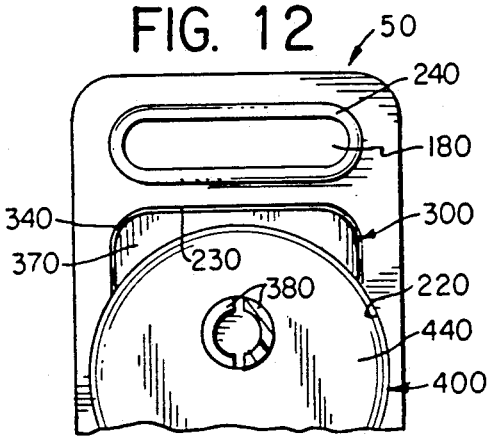
FIG. 12 is a cut-away partially in section view of the key and cover of FIG. 2.
Figure 11:
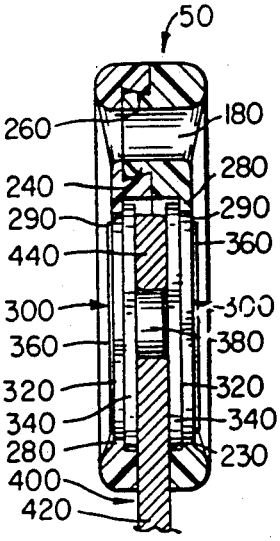
FIG. 11 is a cross-sectional view of the key and cover along line 11—11 of FIG. 2.

The bosses 380 are located on the backs (i.e., inner faces) of the plates 300 so that when the frame 100, with the plates 300 inserted, is folded over onto itself, the bosses 380 together form a circular element which extends through the key ring hole 460 of the key head 440. This is illustrated in FIGS. 11 and 12. The bosses 380 are off center with respect to the key-holding-recesses, and serve to assure that the key head 440 cannot pivot in the cover 50, but remains stationary within the cover 50.

While the invention has been particularly shown and described with reference to preferred embodiments thereof, it will be understood by those skilled in the art that various changes in form and details may be made therein without departing from the spirit and scope of the invention, which are defined by the appended claims.

What is claimed is:

1. A cover for the head of a key, comprising:

a frame, said frame having two halves connected by a hinge arrangement having a central opening, so that a key blade may fit therein but sufficiently small so that the key head cannot pass through it, each of said halves having a key-ring-receiving opening, said key ring receiving openings being aligned when said frame is folded over onto itself, whereby a key blade may be inserted into said opening and the frame folded over onto itself and locked into position so that the head of the key is covered;

at least one insertable insignia plàte comprising a face for bearing an insignia, said face being mounted on a base which is wider than said face, said base also having a back;

at least one of said halves having an insignia-plate-receiving opening, said opening having a lip causing said insignia-plate-receiving opening to be narrower than said base;

said insignia plate being removably insertable into said insignia-plate-receiving opening, said plate prevented from passing through said insignia-plate-receiving opening by said lip.

2. The key cover of claim 1, wherein said insignia plate includes a key-head-retaining means for holding the key head stationary within the cover, said key-head-retaining means extending from said base back and adapted to fit within a key ring hole in the key head.

3. The key cover of the claim 2, wherein said key-head-retaining means comprises a boss on the back of said plate.

4. The key cover of claim 3, wherein each of said frame ha has an opening for receiving said insignia plate.

5. The key cover of claim 4, wherein each insignia plate has a boss, said bosses forming a circular element which extends through the key ring hole when said insignia plates are inserted in said plate-receiving openings and said frame is folded onto itself.

6. The key cover of claim 5, wherein each of said bosses is aligned off center with respect to the key head, said bosses serving to hold the key stationary within the cover.

7. The key cover of claim 3 having a boss on each insignia plate, each boss being circular and having a height that is less than half the thickness of the key head, said bosses being arranged in substantial alignment to face each other when said insignia plates are inserted in said plate-receiving openings and said frame is folded onto itself.

* * * * *